US010480499B2

(12) United States Patent
Hebrard et al.

(10) Patent No.: US 10,480,499 B2
(45) Date of Patent: Nov. 19, 2019

(54) CRANKCASE ASSEMBLY FOR A RECIPROCATING MACHINE

(71) Applicants: Bendix Commercial Vehicle Systems LLC, Elyria, OH (US); KNORR-BREMSE Systeme fuer Nutzfahrzeuge GmbH, Munich (DE)

(72) Inventors: Gilles Hebrard, Lisieux (FR); Jean-Baptiste Marescot, Manerbe (FR); Joerg Mellar, Pliening (DE); Thomas Weinhold, Munich (DE); Thomas Franz, Elyria, OH (US); Jeffrey Geither, Elyria, OH (US); Edward Hoban, Elyria, OH (US); Justin Huffman, Elyria, OH (US); Nicholas Petek, Elyria, OH (US)

(73) Assignees: KNORR-BREMSE Systeme fuer Nutzfahrzeuge GmbH, Munich (DE); Bendix Commercial Vehicle Systems LLC, Elyria, OH (US)

( * ) Notice: Subject to any disclaimer, the term of this patent is extended or adjusted under 35 U.S.C. 154(b) by 398 days.

(21) Appl. No.: 15/012,441

(22) Filed: Feb. 1, 2016

(65) Prior Publication Data

US 2017/0218934 A1 Aug. 3, 2017

(51) Int. Cl.

| | |
|---|---|
| ***F04B 39/06*** | (2006.01) |
| ***F04B 39/00*** | (2006.01) |
| ***F04B 39/12*** | (2006.01) |

(52) U.S. Cl.

CPC ..... *F04B 39/064* (2013.01); *F04B 39/126* (2013.01); *F04B 39/128* (2013.01)

(58) Field of Classification Search

CPC .... F04B 39/128; F04B 39/126; F04B 39/064; F02F 1/16; F02F 1/163; F02F 1/166

(Continued)

(56) References Cited

U.S. PATENT DOCUMENTS 3,403,661 A * 10/1968 Valentine ..... F02F 1/16 123/41.84
3,410,256 A * 11/1968 Herschmann ..... F01P 3/02 123/193.3

(Continued)

FOREIGN PATENT DOCUMENTS

CH 144390 * 12/1930 ..... F02F 11/002
DE 10 2009 011 214 A1 9/2010

(Continued)

OTHER PUBLICATIONS

CH144390 eSpacenet Machine Translation.*

(Continued)

*Primary Examiner* — Thomas E Lazo
*Assistant Examiner* — Dustin T Nguyen
(74) *Attorney, Agent, or Firm* — Crowell & Moring LLP

(57) ABSTRACT

A crankcase assembly for a reciprocating machine is provided in which a crankcase having at least one cylinder with a wet cylinder liner arranged therein. A cylinder head for charging and discharging pressurized gas is mounted on the crankcase and a cylinder head gasket for preventing leakage of pressurized gas out of the cylinder is arranged between the crankcase and the cylinder head and is running circumferentially spaced from the inner wall of the cylinder liner. A circumferential coolant channel is formed between the inner crankcase wall and an outer wall of the cylinder liner, wherein a lower sealing means is arranged between the inner crankcase wall and the cylinder liner on the crankshaft side of the coolant channel for preventing leakage of coolant fluid. An upper sealing means is arranged between the inner crankcase wall and the cylinder liner on the cylinder head side of the coolant channel for preventing leakage of coolant fluid.

16 Claims, 4 Drawing Sheets

(58) Field of Classification Search
USPC ..... 123/41.84, 41.86
See application file for complete search history.

(56) References Cited

U.S. PATENT DOCUMENTS

| | | | | | |
|---|---|---|---|---|---|
| 4,099,725 | A * | 7/1978 | Wolters | F02F 1/16 | 123/193.3 |
| 4,399,783 | A * | 8/1983 | Hauser, Jr. | F16J 10/04 | 123/193.2 |
| 4,417,549 | A * | 11/1983 | Kazenmaier | F02F 1/16 | 123/41.84 |
| 4,616,603 | A * | 10/1986 | Kubis | F02B 75/16 | 123/193.2 |
| 4,791,891 | A * | 12/1988 | Kubis | F02F 11/002 | 123/193.2 |
| 6,116,198 | A * | 9/2000 | Kirtley | F02F 1/163 | 123/193.3 |
| 6,116,874 | A | 9/2000 | Nation et al. | | |
| 6,799,541 | B1 | 10/2004 | Clinton et al. | | |
| 7,975,601 | B2 * | 7/2011 | Hittle | F16J 10/04 | 92/169.2 |
| 8,057,193 | B2 | 11/2011 | Koeck | | |
| 8,117,960 | B2 | 2/2012 | Hartl et al. | | |
| 8,337,177 | B2 | 12/2012 | Mezza et al. | | |
| 9,482,178 | B2 * | 11/2016 | Batta | F02F 11/005 | |
| 2008/0213115 | A1 * | 9/2008 | Hilger | F04B 9/042 | 417/569 |
| 2010/0139607 | A1 * | 6/2010 | Herbst-Dederichs | C23C 4/02 | 123/193.2 |
| 2012/0240883 | A1 | 9/2012 | McGiffin et al. | | |

FOREIGN PATENT DOCUMENTS

| | | | | |
|---|---|---|---|---|
| DE | 10 2011 121 750 | A1 | 6/2013 | |
| EP | 2 226 503 | A1 | 9/2010 | |
| GB | 2 004 602 | A | 4/1979 | |
| GB | 2004602 | * | 4/1979 | F02F 1/16 |

OTHER PUBLICATIONS

International Search Report (PCT/ISA/220 & PCT/ISA/210) issued in PCT Application No. PCT/US2017/015718 dated Apr. 4, 2017 (Three (3) pages).

Written Opinion (PCT/ISA/237) issued in PCT Application No. PCT/US2017/015718 dated Apr. 4, 2017 (Eight (8) pages).

International Preliminary Report on Patentability (PCT/IB/326 & PCT/IB/373) issued in PCT Application No. PCT/US2017/015718 dated Aug. 16, 2018, including document C2 (Written Opinion (PCT/ISA/237) previously filed on May 31, 2017) (11 pages).

* cited by examiner

CRANKCASE ASSEMBLY FOR A RECIPROCATING MACHINE

BACKGROUND AND SUMMARY OF THE INVENTION

The invention relates to crankcase assemblies for reciprocating machines, and in particular to crankcases having at least one cylinder with a wet cylinder liner arrangement. The invention is suitable for stationary or mobile use, including commercial vehicle reciprocating compressors having a wet cylinder liner. Such liners are used in particular in die casted crankcases, for example pressure die casted aluminum crankcases.

In such a crankcase assembly a cylinder head for charging and discharging pressurized gas is mounted on the crankcase. A cylinder head gasket for preventing leakage of pressurized gas out of the cylinder is arranged at the cylinder head, circumferentially spaced from the inner wall of the cylinder liner. A circumferential coolant channel is formed between an inner crankcase wall and an outer wall of the cylinder liner. A lower sealing arrangement is provided between the inner crankcase wall and the cylinder liner on the crankshaft side of the coolant channel to inhibit leakage of coolant. A first upper sealing arrangement is provided between the inner crankcase wall and the cylinder liner on the cylinder head side of the coolant channel to inhibit leakage of coolant to the cylinder head side.

In one design of pressure die casted aluminum crankcases having wet cylinder liners, the liners are inserted into the crankcase cylinder only after the casting process, which allows for a less complex casting process. In such a design, the cylinder liners are usually inserted into the cylinders of the crankcase with an interference fit, with coolant channels surrounding the region of the cylinder running surface of the wet cylinder liner. The outer wall of the liner and the crankcase cylinder form a ring shaped room for the coolant fluid. The liner is in direct contact with the coolant fluid, hence called a wet liner.

For example in commercial vehicle compressor applications, the coolant fluid is supplied by the heavy duty engine to which the gear driven compressor is connected. A typical coolant pressure delivered by such engines is in the range of up to 3.5 bar (50.8 psi) relative. Some newer engines are designed for coolant pressures up to 6.5 bar (94.3 psi). Further, depending on the number and type of further auxiliary equipment to be cooled, coolant pressures temporarily may even go further up. Additionally, the oscillating pressure of the gas pressurized within the cylinder acts on the sealing means which is arranged between the inner crankcase wall and the cylinder liner on the cylinder head side. These higher pressures increase the potential for leakage of prior sealing designs, for example as a result of worn sealing means at the cylinder head side permitting leakage of pressurized gas into the coolant channel. Further, these higher pressures may overload lower sealing means between the inner crankcase wall and the cylinder liner on the crankshaft side of the coolant channel, potentially resulting in coolant leakage into the reciprocating machine oil circuit.

Known reciprocating machines often provide cast in liners to minimize the potential for leakage. This solution is not applicable for pressure die casting crankcases, as a core for the water channel cannot be removed after casting. It is also known to use steel beaded cylinder head gaskets for sealing the oscillating gas pressure within the cylinder; however, if the sealing means of the cylinder head gasket is arranged close to the inner diameter of the liner while the cylinder head bolts are at a radial distance to the gasket sealing means, moment loads can cause an umbrella-like deformation of the cylinder head (more precisely, of the valve plate arranged at the cylinder head gasket). This creates a risk for loosened bolts during use. A further risk is that the cylinder liner deforms in a way that oil can pass the piston rings and be carried by the gas compressed by the compressor into the brake system.

Therefore, it is an object of the present invention to overcome the disadvantages of the known designs and to provide an enhanced crankcase assembly for a reciprocating machine.

The present invention provides a crankcase assembly for a reciprocating machine, with a crankcase having at least one cylinder having a wet cylinder liner arranged therein. A cylinder head for charging and discharging pressurized gas is mounted on the crankcase and a cylinder head gasket for preventing leakage of pressurized gas out of the cylinder is arranged between the crankcase and the cylinder head. The cylinder head gasket is circumferentially spaced from the inner wall of the cylinder liner.

A circumferential coolant channel is formed between the inner crankcase wall and an outer wall of the cylinder liner, wherein a lower sealing arrangement is provided between the inner crankcase wall and the cylinder liner on the crankshaft side of the coolant channel to prevent coolant leakage from the coolant channel into the crankcase (and the oil therein). A first upper sealing arrangement is provided between the inner crankcase wall and the cylinder liner on the cylinder head side of the coolant channel to prevent coolant leakage to the cylinder head side. Separate from the first upper sealing arrangement, a second upper sealing arrangement is provided to prevent pressurized gas affecting the first upper sealing arrangement.

As indicated above, a crankcase assembly for a reciprocating machine, with at least one cylinder comprising a wet cylinder liner arranged therein is provided. Such a cylinder liner is known as "wet" cylinder liner as coolant flows along its outer wall for cooling the running surface of the piston within the cylinder. In the following, for simplification, the wet cylinder liner is also referred to as a "cylinder liner" or a "liner."

The crankcase assembly includes a cylinder head mounted on the crankcase for charging unpressurized gas into the cylinder and for discharging pressurized gas out of the cylinder. The cylinder head usually includes a valve plate having valves provided on top of the cylinder space for the control of the charging and discharging of gas. In the description of the present invention no distinction will be made among the valve plate and the cylinder head, as the valve plate is considered to be an element of the cylinder head.

Between the cylinder head and the crankcase, a cylinder head gasket is arranged which provides sealing to prevent leakage of pressurized gas out of the cylinder. In one example, the cylinder head sealing arrangement is a bead is circumferentially spaced from the inner wall of the cylinder liner, thereby establishing a seal between the top surface of the crankcase and/or the top surface of the cylinder liner and the surface of the cylinder head facing the top surface of the crankcase and/or the top surface of the cylinder liner. With the sealing arrangement of the cylinder head gasket also running spaced from the outer wall of the cylinder liner, the pressurized gas acts on the contact area between the crankcase wall and the cylinder liner.

A circumferential coolant channel is formed between the inner crankcase wall and an outer wall of the cylinder liner.

A coolant fluid under high pressure is guided through the coolant channel for cooling the running surface of the cylinder adjacent to the compressor piston reciprocating within the cylinder liner. Depending on the embodiment, the coolant channel may be ring-shaped and extend axially over a portion of the axial length of the cylinder liner sufficient to provide a desired cooling capacity. A lower sealing arrangement is provided between the inner crankcase wall and the cylinder liner to prevent coolant leakage to the crankshaft side of the crankcase. The lower sealing arrangement may be formed by a sealing ring such as an O-ring or the like, and may be provided in a circumferential groove in the cylinder liner wall or in the inner wall of the crankcase. Likewise, the lower sealing arrangement may be formed by an adhesive or another suitable sealing substance which is applied on the mating surfaces of the cylinder liner and the crankcase cylinder. Also, the lower sealing arrangement may be provided by the interference fit between the cylinder liner wall and the inner wall of the crankcase, for example, by including circumferential spring-back grooves on the cylinder liner wall or the inner wall of the crankcase, into which material of the opposite mating surface penetrates to form a seal. The lower sealing arrangement also may be formed by any other appropriate configuration of materials and/or contours between the inner crankcase wall and the cylinder liner inserted therein that prevents coolant leakage into the crankshaft side of the crankcase.

A first upper sealing arrangement is provided between the inner crankcase wall and the cylinder liner on the cylinder head side of the coolant channel to prevent coolant leakage to the cylinder head side. The first upper sealing arrangement may be formed by a sealing ring such as an O-ring or the like provided in a circumferential groove in the inner crankcase wall or in the cylinder liner wall, for example, by including surfaces of a circumferential shoulder of the cylinder liner adjacent to the wall of the crankcase cylinder. The first upper sealing arrangement also may be formed by a sealing substance applied between the inner crankcase wall and the cylinder liner on the cylinder head side of the coolant channel, or by any other suitable configuration of materials and/or contours between the inner crankcase wall and the cylinder liner inserted therein that prevents coolant leakage on the cylinder head side of the coolant channel.

The first upper sealing arrangement is present to prevent coolant leakage to the cylinder head side, and is therefore exposed to the pressure of the coolant fluid. From the cylinder head side, the oscillating pressure of the gas pressurized within the cylinder acts on the contact area between the inner crankcase wall and the outer wall of the cylinder liner. In order to prevent the oscillating gas pressure acting on the first upper sealing arrangement, a second upper sealing arrangement is provided separate from the first upper sealing arrangement. The second upper sealing arrangement is provided separate to the first upper sealing arrangement to prevent interaction of the coolant pressure and the oscillating pressure of the gas affecting the first upper sealing arrangement. Specifically, the second upper sealing arrangement is arranged to prevent the pressurized gas from penetrating the contact area between the inner crankcase wall and the outer wall of the cylinder liner up to the position of the first upper sealing arrangement.

In one embodiment of the crankcase assembly, the second upper sealing arrangement is provided between the inner crankcase wall and the cylinder liner. The second upper sealing arrangement may be formed by a sealing ring such as an O-ring or the like provided in a circumferential groove in the inner crankcase wall or in the cylinder liner wall, for example, by including the surfaces of a circumferential shoulder of the cylinder liner adjacent to the wall of the crankcase cylinder. The second upper sealing arrangement also may be formed by a sealing substance applied between the inner crankcase wall and the cylinder liner on the cylinder head side of the first upper sealing arrangement, or by any other suitable sealing arrangement between the inner crankcase wall and the cylinder liner on the cylinder head side of the first upper sealing arrangement that prevents pressurized gas from acting on the first upper sealing arrangement.

In one embodiment of the crankcase assembly, the cylinder liner includes a radially protruding circumferential shoulder, in particular on the cylinder head side of the coolant channel. When mounted to the crankcase, the shoulder is arranged in a corresponding recess of the inner crankcase wall. Thus, the shoulder enhances the assembly of the cylinder liner within the crankcase by assisting in defining the axial position of the liner within the crankcase cylinder. In crankcase assemblies of the present type, the cylinder liner is inserted only after casting. In many applications the crankcase cylinder-to-cylinder liner interface is an interference fit which is created via a shrinking process. Such an interference fit may be designed such that a sealing connection between the cylinder liner and the inner wall of the crankcase cylinder is established.

In one embodiment of the crankcase assembly, the first upper sealing arrangement and/or the second upper sealing arrangement is provided between the circumferential shoulder of the cylinder liner and the inner crankcase wall. In an embodiment with the circumferential shoulder arranged in a corresponding recess of a cylinder wall, the first upper sealing arrangement and/or the second upper sealing arrangement is arranged between the outer wall of the circumferential shoulder of the cylinder liner and the corresponding wall of the recess of the cylinder wall. In an embodiment with the radially protruding circumferential shoulder of the cylinder liner arranged at the top end of the cylinder liner, this design provides for a coolant channel that extends up to the circumferential shoulder. This enables cooling of the surface along which the piston moves up to the position of the circumferential shoulder. In a design with both the first and second upper sealing arrangements provided between the circumferential outer wall of the radially protruding circumferential shoulder of the cylinder liner and the corresponding recess of the inner crankcase wall (with the first upper sealing arrangement being separate from the second upper sealing arrangement), a cost-efficient parallel manufacture and assembly of both upper sealing arrangements is possible.

In a further embodiment of the crankcase assembly, the second upper sealing arrangement is provided on the cylinder head side of the cylinder liner, in particular on the axial end face of the cylinder liner. In such a design, the pressurized gas is prevented from acting on the contact area between the inner crankcase wall and the outer wall of the cylinder liner. In one optional design, the sealing arrangement is arranged in a circumferential step in the axial end face of the cylinder liner or in the axial end face of the crankcase surrounding the cylinder liner. This design enables the second upper sealing arrangement to be provided in such a way that it forms a seal between the axial end face of the cylinder liner and the cylinder head and at the same time it forms a seal between the radial surface of the cylinder liner and the outer wall of the recess in the inner crankcase wall.

In a further embodiment of the crankcase assembly, the second upper sealing arrangement is formed by the cylinder head gasket. In such a design, the cylinder liner includes at its cylinder head side a radially protruding circumferential shoulder having an enlarged diameter to enable the arrangement of the seal (e.g., a sealing bead) of the cylinder gasket both at a distance from the inner diameter of the cylinder liner and also close to the cylinder head bolts. This design provides reliable protection against leakage of pressurized gas which could affect the first upper sealing arrangement, without creating a risk for loosened bolts.

In a further embodiment of the crankcase assembly, the first upper sealing arrangement and/or the second upper sealing arrangement and/or the lower sealing arrangement is provided in a circumferential groove formed in the outer wall of the cylinder liner or in a circumferential groove formed in the inner crankcase wall. Depending on the type of the sealing and/or the available manufacturing processes, the provision of more circumferential grooves formed at the outer wall of the cylinder liner or in the inner crankcase wall may be possible. The provision of circumferential grooves for the sealing arrangement at the same wall (either at the outer wall of the cylinder liner or the inner crankcase wall) is advantageous in that there is no requirement to further machine the surface opposite to the respective groove for many types of seal arrangements.

In a further embodiment of the crankcase assembly, the first upper sealing arrangement is provided between a chamfer arranged at the crankshaft side of a radially protruding circumferential shoulder of the cylinder liner and a corresponding recess of the cylinder wall in which the circumferential shoulder of the cylinder liner is arranged. Such a design enables an easy manufacture of the chamfer as a groove for the sealing arrangement and a simplified mounting of the sealing arrangement, as the recess for receiving the circumferential shoulder formed in the inner crankcase wall is usually easy to access. As this design provides for two sealing surfaces (in particular axial and radial), the sealing effect of such a design is improved.

In a further embodiment of the crankcase assembly, the first upper sealing arrangement and/or the second upper sealing arrangement is an O-ring seal, a V-seal, X-seal, quad-ring-seal, and/or a ring-seal with any other suitable cross-section geometry. The first upper sealing arrangement and/or the second upper sealing arrangement may also include any other suitable type of sealing, for example, a sealing fluid, a viscous sealing material and/or a pasty sealing material. The use of O-rings in an upper sealing arrangement is for example a cost-efficient option for providing reliable sealing.

In a further embodiment of the crankcase assembly, at least one venting channel is arranged between the first and second upper sealing arrangements for venting any pressurized gas which seeps through the second upper sealing arrangement and for draining of coolant fluid which seeps through the first upper sealing arrangement. With the at least one venting channel, an interaction between the first and second upper sealing arrangements, in particular a negative effect of pressurized gas which overcomes the second upper sealing arrangement on the first upper sealing arrangement, is prevented. One embodiment of the at least one venting channel connects the area between the first and second upper sealing arrangements with the environment outside the crankcase. In one embodiment the at least one venting channel is connected to a detector which serves for an early detection of malfunction of one of the first and second upper sealing arrangements.

The invention further provides a reciprocating compressor having a crankcase assembly of the present invention.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
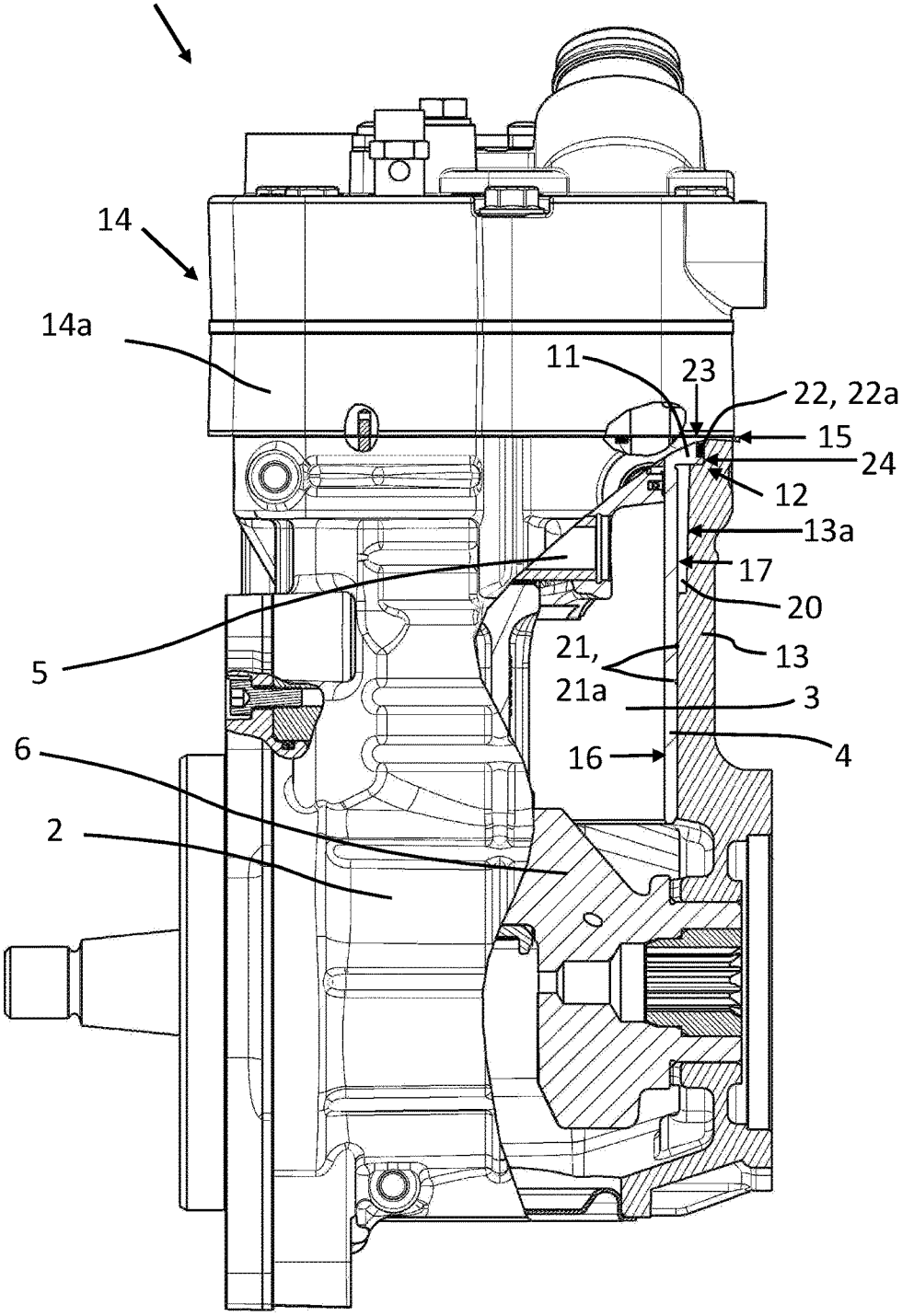
FIG. 1 is a view of a known crankcase assembly with a partial cross-section illustrating the arrangement of a wet cylinder liner within the cylinder of the crankcase.

FIG. 1 shows a crankcase assembly 1 for a reciprocating machine. The shown reciprocating machine is a gear driven compressor for preparing pressurized air in a commercial vehicle system, having one cylinder 3 with a piston 5 mounted on a crankshaft 6. The piston 5 runs within a wet cylinder liner 4 arranged within the cylinder 3 of the crankcase 2.

The cylinder liner 4 is arranged within the cylinder 3 of the crankcase 2 and mounted with an interference fit. The cylinder liner 4 comprises a radially protruding circumferential shoulder 11 which is arranged in a corresponding recess 12 in the inner crankcase wall 13 in the shown assembly position. The upper end face of the cylinder liner 4 is in an even position with the upper end face of the crankcase 2. A cylinder head 14 for charging and discharging of pressurized gas is mounted on top of the crankcase 2. A valve plate 14*a* of the cylinder head 14 includes valves therefor. A cylinder head gasket 15 is arranged between the crankcase 2 and the cylinder head 14 for preventing leakage of pressurized gas out of the cylinder 3.

A circumferential coolant channel 20 is formed between a recess 13*a* in the inner crankcase wall 13 and the outer wall 17 of the cylinder liner 4. A coolant under pressure is provided by the engine of the commercial vehicle system and is guided through the coolant channel 20. The recess 13*a* is arranged in an upper axial position of the cylinder 3 to provide coolant to the upper axial area of the cylinder liner 4, an area which is highly thermally-loaded, for cooling the running face of the piston 5.

A lower seal arrangement 21 in form of spring grooves 21*a* is arranged between the inner crankcase wall 13 and the cylinder liner 4 on the crankshaft side of the coolant channel 20 for preventing leakage of coolant fluid. The sealing effect is provided by material of the inner crankcase wall 13 of the crankcase 2, which is entering the spring grooves 21*a* due to the load of the interference fit and thereby forming a sealing bead at the spring grooves 21*a*. A first upper sealing arrangement 22 is provided between the inner crankcase wall 13 and the cylinder liner 4 on the cylinder head side of the coolant channel 20 to prevent leakage of coolant fluid to the cylinder head side and to prevent pressurized air from the cylinder leaking into the coolant channel 20. The first upper sealing arrangement 22 is formed by an O-ring 22*a* arranged in a circumferential groove 23 at the outer radial wall 24 of the radially protruding circumferential shoulder 11 of the cylinder liner 4.

In this prior art design, pressurized air from the cylinder 3 and coolant from the coolant channel 20 can both affect the first upper sealing arrangement 22.

Figure 2:
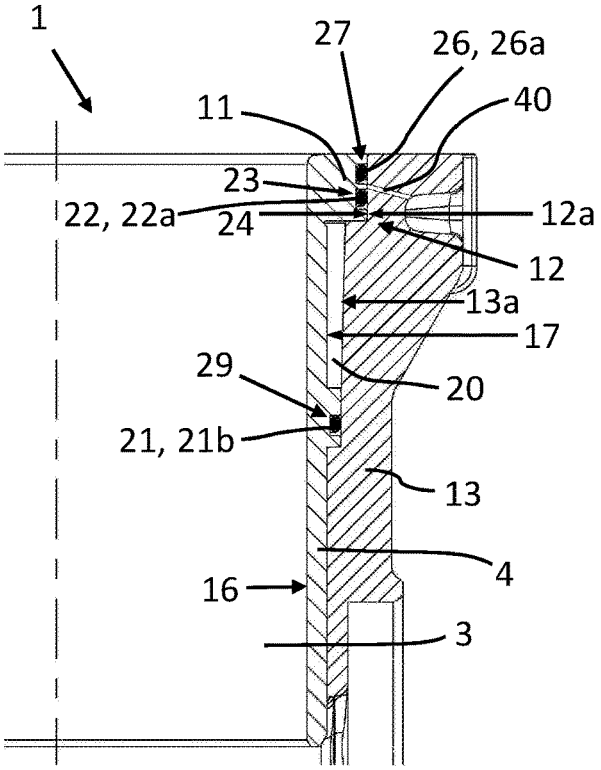
FIG. 2 is a partial cross-section view of a first embodiment of a crankcase assembly according to the invention.

FIG. 2 shows a partial sectional view of a first embodiment of a crankcase assembly 1 according to the invention. The crankcase assembly of FIG. 2 corresponds to a substantial proportion to the embodiment shown in FIG. 1, therefore only those elements differing from the embodiment of FIG. 1 will be explained.

In the embodiment of FIG. 2, a second upper sealing arrangement 26 in form of an O-ring 26*a* is arranged above and separate from the first upper sealing arrangement 22 which is also provided in form of an O-ring 22*a*. The O-ring 26*a* is arranged in a circumferential groove 27 arranged at the outer radial wall 24 of the radially protruding circumferential shoulder 11 of the cylinder liner 4. As each upper sealing arrangement 22, 26 is provided in a separate circumferential groove 23, 27, there is no interaction between the upper sealing arrangement 22, 26.

In the radial wall 12*a* of the recess 12 at least one venting channel 40 is provided for guiding air or coolant from the area between the first and second upper sealing arrangements 22, 26 to the environment. The venting channel 40 provides atmospheric pressure level in this area, precluding any fluid or gas from leaking past one of the sealing arrangements 22, 26.

In the embodiment shown in FIG. 2, the lower sealing arrangement 21 is also designed as O-ring 21*b* arranged in a circumferential groove 29 provided in the outer wall of the cylinder liner 4. As all three sealing arrangements 21, 22, 26 provided between the inner crankcase wall 13 and the cylinder liner 4 are designed as O-rings which are arranged within circumferential grooves 23, 27, 29, the manufacture of the circumferential grooves is facilitated.

Figure 3:
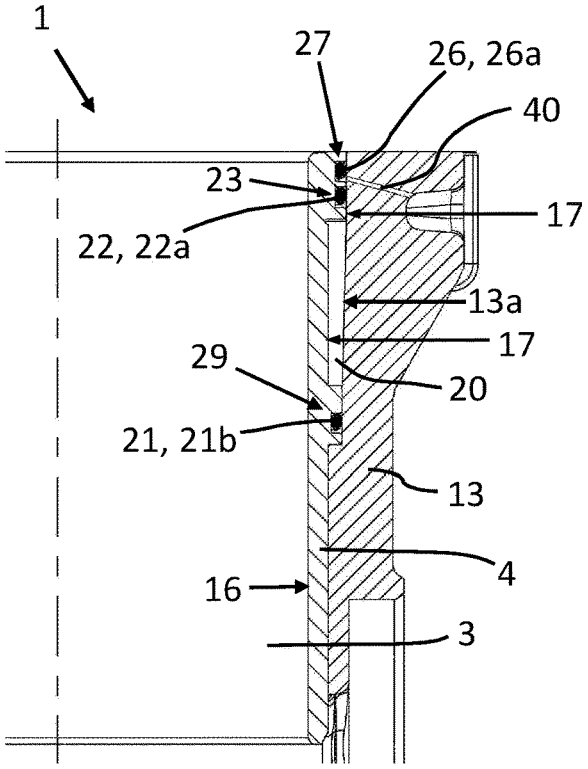
FIG. 3 is a partial cross-section view of a second embodiment of a crankcase assembly according to the invention.

FIG. 3 shows a partial sectional view of a second embodiment of a crankcase assembly 1 according to the invention. Those features which correspond to the embodiment shown in FIG. 1 or 2 will not be addressed. The embodiment shown in FIG. 3, differs from the embodiment of FIG. 2 in that the cylinder liner 4 does not include a circumferential shoulder 11. The axial position of the cylinder liner 4 within the crankcase 2 is defined by a radial step in the outer wall of the cylinder liner 4 below the circumferential groove 29 for the lower sealing arrangement 21. This radial step is fitted in a corresponding radial step in the inner crankcase wall 13.

As the cylinder liner 4 of the embodiment of FIG. 3 does not include a circumferential shoulder, the first and second upper sealing arrangements 22, 26 are provided in circumferential grooves 23 and 27 which are arranged at the outer wall 17 of the cylinder liner 4. The sealing arrangements 22, 26 are also formed by O-rings 22*a*, 26*a* having a smaller diameter than the O-rings 22*a*, 26*a* of the embodiment shown in FIG. 2. At least one venting channel 40 is provided in the inner crankcase wall 13 connecting the area between the first and second upper sealing arrangements 22, 26 to the environment.

Figure 4:
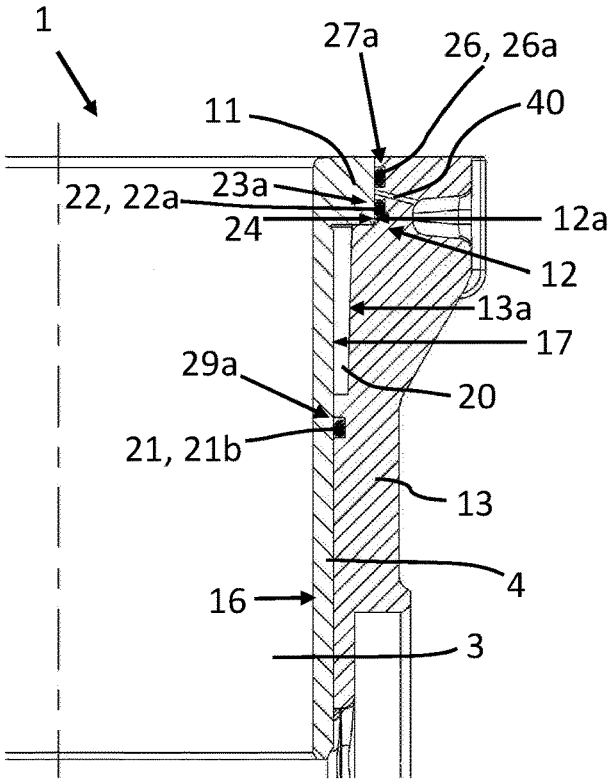
FIG. 4 is a partial cross-section view of a third embodiment of a crankcase assembly according to the invention.

FIG. 4 shows a partial sectional view of a third embodiment of a crankcase assembly 1 according to the invention. Those features which correspond to the embodiment shown in FIG. 1 or 2 will not be addressed. In the embodiment shown in FIG. 4, the lower and upper sealing arrangements 21, 22, 26 are arranged at the same axial sealing positions between the inner crankcase wall 13 and the cylinder liner 4 as in the embodiment shown in FIG. 2. The embodiment of FIG. 4 differs from the embodiment of FIG. 2 in particular in that the sealing arrangements 21, 22, 26 are provided in circumferential grooves 23*a*, 27*a*, 29*a* which are provided in the inner crankcase wall 13 of the cylinder 3. For the design of FIG. 4, the sealing arrangements 21, 22, 26 are also formed by O-rings 21*b*, 22*a*, 26*a* having an enlarged diameter in comparison with the O-rings 21*b*, 22*a*, 26*a* of the embodiment shown in FIG. 2. Also in this embodiment, at least one venting channel 40 is provided in the inner crankcase wall 13 connecting the area between the first and second upper sealing arrangements 22, 26 to the environment.

Figure 5:
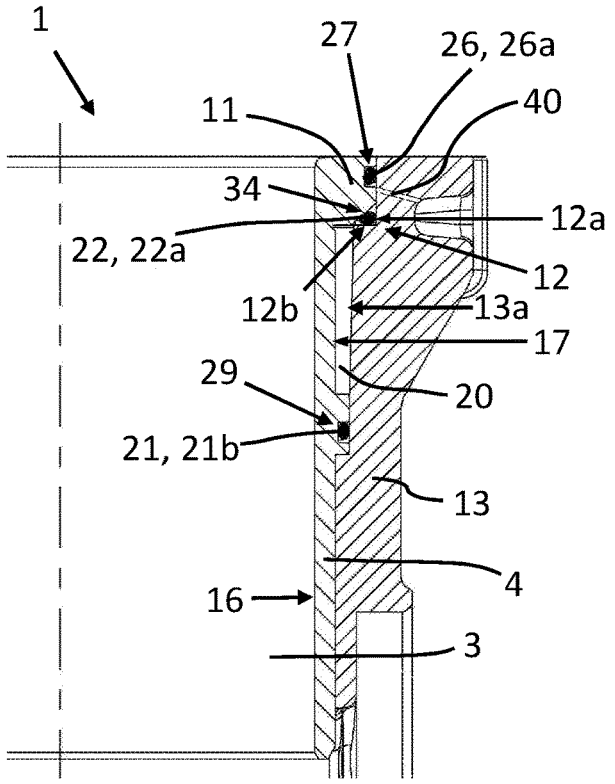
FIG. 5 is a partial cross-section view of a fourth embodiment of a crankcase assembly according to the invention.

FIG. 5 shows a partial sectional view of a further embodiment of a crankcase assembly 1 according to the invention. The embodiment shown in FIG. 5 corresponds to a substantial proportion with the embodiment of FIG. 2. Features corresponding with the embodiment of FIG. 2 will therefore not be addressed.

The embodiment of FIG. 5 differs from the embodiment of FIG. 2 in that the first upper sealing arrangement 22 is provided in a circumferential recess formed by a chamfer 34 at the lower end of the radially protruding circumferential shoulder 11 of the cylinder liner 4. Also in the embodiment of FIG. 5, the first upper sealing arrangement 22 is formed by an O-ring 22*a* which in this embodiment seals at two surfaces, the radial wall 12*a* and the axial wall 12*b* of the recess 12 arranged at the upper end of the cylinder 3.

Figure 6:
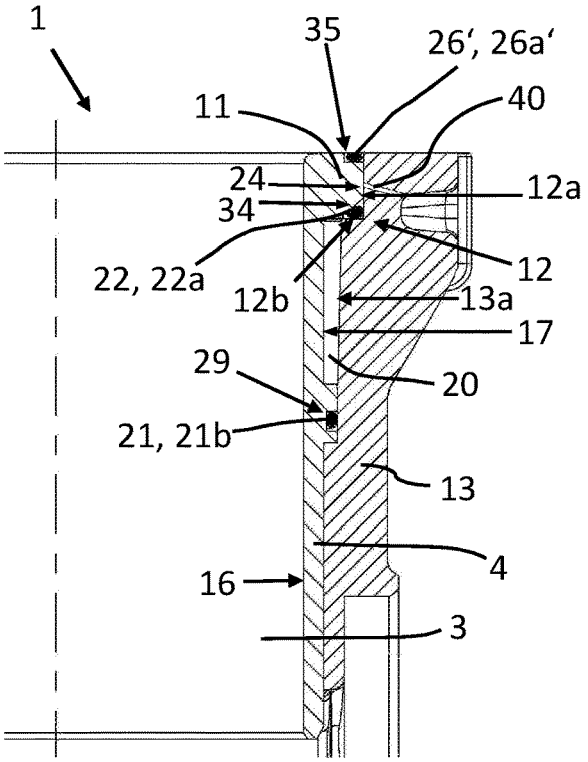
FIG. 6 is a partial cross-section view of a fifth embodiment of a crankcase assembly according to the invention.

FIG. 6 shows a partial sectional view of a further embodiment of a crankcase assembly 1 according to the invention. The embodiment shown in FIG. 6 corresponds to a substantial proportion with the embodiment of FIG. 5. Features corresponding with the embodiment of FIG. 5 will therefore not be addressed.

The embodiment of FIG. 6 differs from the embodiment of FIG. 5 in that the second upper sealing arrangement 26' is provided in a circumferential recess formed by a step 35 at the outer upper end (end face) of the radially protruding circumferential shoulder 11 of the cylinder liner 4. Also in the embodiment of FIG. 6, the second upper sealing arrangement 26' is formed by an O-ring 26*a*' which in this embodiment seals at two surfaces at the same time, one of which is the radial wall 12*a* of the recess 12 at the upper end of the cylinder 3. The second sealing surface of the upper sealing arrangement 26' is at the cylinder head 14 with its valve plate 14*a*. In this manner, the sealing arrangement 26' seals the pressurized air within the cylinder 3 at the cylinder head 14. In this embodiment the second upper sealing arrangement is referred to as 26' instead of 26 as the second upper sealing arrangement also serves as cylinder head gasket, hence an additional cylinder head gasket 15 is not necessary in the embodiment of FIG. 6. The sealing arrangement 26' seals the pressurized air within the cylinder 3 at the cylinder head 14 in a way that it cannot act on the contact area of crankcase 2 and cylinder liner 4 at the edge of the circumferential shoulder 11 of the cylinder liner 4. As a second effect, the sealing arrangement 26' further seals the contact area of the cylinder 3 of the crankcase 2 and the cylinder liner 4 at the outer radial wall 24 of the circumferential shoulder 11 of the cylinder liner 4 for preventing any pressurized air to penetrate into this contact area which has overcome the first sealing surface of the second upper sealing arrangement 26' at the cylinder head 14.

This embodiment has the additional advantage that the manufacture of the step 35 forming the circumferential recess for receiving the second upper sealing arrangement 26' is easy to manufacture and an O-ring 26*a*', forming the second upper sealing arrangement 26', is easy to assemble as the step 35 is arranged at the end face of the cylinder liner 4.

Figure 7:
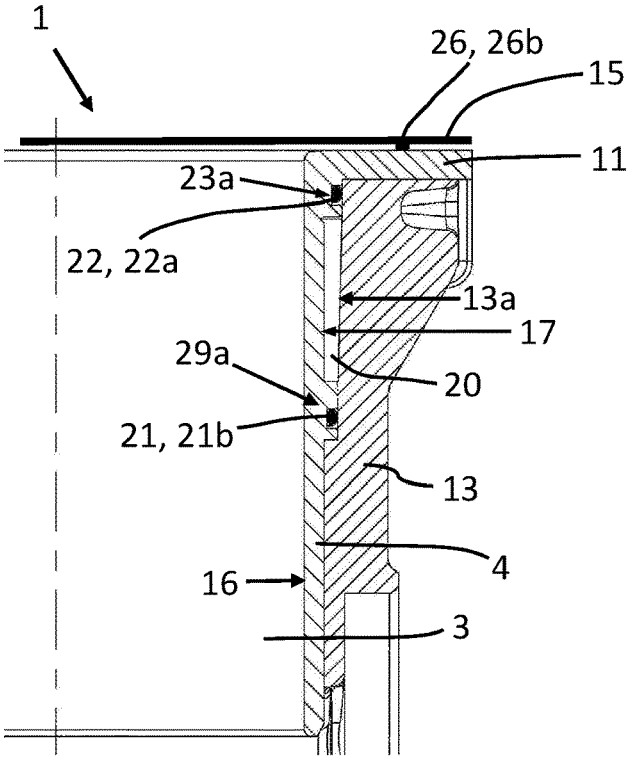
FIG. 7 is a partial cross-section view of a sixth embodiment of a crankcase assembly according to the invention.

FIG. 7 shows a partial sectional view of a further embodiment of a crankcase assembly 1 according to the invention. The embodiment shown in FIG. 7 corresponds to a substantial proportion with the embodiments of FIG. 1 to FIG. 6. Features corresponding with these embodiments will therefore not be addressed.

The first upper sealing arrangement 22 in the embodiment of FIG. 7 is formed by an O-ring 22*a* arranged in the same manner as shown in the embodiments of FIG. 1 and FIG. 2. In the same way it is also possible to arrange the first upper sealing arrangement 22 in the same manner as shown in the embodiments of FIGS. 3 to 6.

In the embodiment shown in FIG. 7, the second upper sealing arrangement 26 is formed by a bead 26*b* of the cylinder head gasket 15 provided between the upper end of the crankcase 2 and cylinder liner 4, respectively, and the cylinder head 14 and the valve plate 14*a* of the cylinder head 14, respectively.

In the embodiment shown in FIG. 7, the radially protruding circumferential shoulder 11 of the cylinder liner 4 is provided with an enlarged diameter which is of sufficient size that the second upper sealing arrangement 26 provided by the cylinder head gasket 15, i.e. the bead 26*b*, is arranged thereon at a distance from the inner diameter of the cylinder liner 4 (allowing for the arrangement of the valves of the cylinder head 14) and also close to the cylinder head bolts for improved stability.

The shown embodiments illustrate different possibilities to arrange the lower sealing arrangement 21 and first and second upper sealing arrangements 22, 26. Without departing from the scope of the invention, it is also possible to use various alternatives for arranging the lower sealing arrangement 21 and the first and second upper sealing arrangements 22, 26, and to do so in other suitable combinations that achieve the sealing performance of the foregoing embodiments.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE SIGNS

1 crankcase assembly
2 crankcase
3 cylinder
4 cylinder liner
5 piston
6 crankshaft
11 radially protruding circumferential shoulder
12 recess in the cylinder wall
12*a* radial wall of the recess
13 inner crankcase wall
13*a* recess in the inner crankcase wall
14 cylinder head
14*a* valve plate of the cylinder head
15 cylinder head gasket
16 inner wall of the cylinder liner
17 outer wall of the cylinder liner
20 coolant channel
21 lower sealing arrangement
21*a* spring grooves
21*b* O-ring
22 first upper sealing arrangement
22*a* O-ring
23 circumferential groove
23*a* circumferential groove
24 circumferential outer wall of the radially protruding circumferential shoulder
26, 26' second upper sealing arrangement
26*a*, 26*a*' O-ring
26*b* bead of the cylinder head gasket
27 circumferential groove
27*a* circumferential groove
29 circumferential groove
29*a* circumferential groove
34 chamfer
35 step
40 venting channel

What is claimed is:

1. A crankcase assembly for a reciprocating machine, comprising:

a crankcase configured to receive a crankshaft therein;

a wet cylinder liner, the wet cylinder liner being located in the crankcase;

a cylinder head configured to charge gas into the wet cylinder liner and discharge pressurized gas from the wet cylinder liner, the cylinder head being mounted on the crankcase at a cylinder head side of the wet cylinder liner opposite a crankshaft side of the wet cylinder liner;

a cylinder head gasket between the cylinder head and the crankcase configured to prevent leakage of pressurized gas from the wet cylinder liner, the cylinder head gasket being disposed circumferentially spaced from an inner wall of the wet cylinder liner, a circumferential coolant channel formed between the inner crankcase wall and an outer wall of the wet cylinder liner;

a lower sealing arrangement located between the inner crankcase wall and the wet cylinder liner on a crankshaft side of the circumferential coolant channel, the lower sealing arrangement being configured to prevent leakage of coolant fluid;

a first upper sealing arrangement located between the inner crankcase wall and the wet cylinder liner on a cylinder head side of the circumferential coolant channel, the first upper sealing arrangement being configured to prevent leakage of coolant; and a second upper sealing arrangement spaced axially apart from the first upper sealing arrangement, the second upper sealing arrangement being located radially between and in contact with the inner crankcase wall and the wet cylinder liner, and axially between the first upper sealing arrangement and a cylinder head end of the wet cylinder liner within a groove in at least one of the wet cylinder liner and the inner crankcase wall in an inner region of the wet cylinder liner in which gas is pressurized, the second upper sealing arrangement being configured to prevent pressurized gas being applied to the first upper sealing arrangement, wherein the wet cylinder liner includes a radially protruding circumferential shoulder on the cylinder head side of the coolant channel, and the first upper sealing arrangement is provided between a chamfer at a crankshaft side of the radially protruding circumferential shoulder of the wet cylinder liner and a corresponding recess of the inner crankcase wall in which the circumferential shoulder of the wet cylinder liner is located.

2. The crankcase assembly according to claim 1, wherein at least one of the first upper sealing arrangement and the second upper sealing arrangement is located between the circumferential shoulder of the wet cylinder liner and the inner crankcase wall.

3. The crankcase assembly according to claim 1, wherein the second upper sealing arrangement is arranged on the cylinder head side of the wet cylinder liner or on a cylinder head side of the crankcase.

4. The crankcase assembly according to claim 1, wherein at least one of the first upper sealing arrangement, the second upper sealing arrangement and the lower sealing arrangement is arranged in a circumferential groove formed in the outer wall of the wet cylinder liner or in a circumferential groove formed in the inner crankcase wall.

5. The crankcase assembly according to claim 1, wherein at least one of the first upper sealing arrangement and the second upper sealing arrangement includes at least one of an O-ring seal, a V-seal, a X-seal, a quad-ring-seal, a ring-seal, a sealing fluid, and a paste sealant.

6. The crankcase assembly according claim 1, wherein at least one venting channel is arranged in the inner crankcase wall between the first upper sealing arrangement and the second upper sealing arrangement.

7. A reciprocating compressor, comprising:

a crankcase assembly according to claim 1.

8. A method of assembling a crankcase assembly for a reciprocating machine, comprising the acts of:

providing a crankcase configured to receive a crankshaft therein;

inserting a wet cylinder liner into the crankcase;

mounting a cylinder head configured to charge gas into the wet cylinder liner and discharge pressurized gas from the cylinder on the crankcase at a cylinder head side of the wet cylinder liner opposite a crankshaft side the wet cylinder liner with a cylinder head gasket between the cylinder head and the crankcase, wherein the cylinder head gasket is configured to prevent leakage of pressurized gas from the wet cylinder liner and is disposed circumferentially spaced from an inner wall of the wet cylinder liner, and upon inserting the wet cylinder liner into the crankcase a circumferential coolant channel is formed between the inner crankcase wall and an outer wall of the wet cylinder liner, a lower sealing arrangement is located between the inner crankcase wall and the wet cylinder liner on a crankshaft side of the circumferential coolant channel, the lower sealing arrangement being configured to prevent leakage of coolant fluid, a first upper sealing arrangement is located between the inner crankcase wall and the wet cylinder liner on a cylinder head side of the circumferential coolant channel, the first upper sealing arrangement being configured to prevent leakage of coolant fluid, a second upper sealing arrangement spaced axially apart from the first upper sealing arrangement is located radially between and in contact with the inner crankcase wall and the wet cylinder liner, and axially between the first upper sealing arrangement and a cylinder head end of the wet cylinder liner within a groove in at least one of the wet cylinder liner and the inner crankcase wall in an inner region of the wet cylinder liner in which gas is pressurized, the second upper sealing arrangement being configured to prevent pressurized gas being applied to the first upper sealing arrangement the wet cylinder liner includes a radially protruding circumferential shoulder on the cylinder head side of the coolant channel, and the first upper sealing arrangement is provided between a chamfer at a crankshaft side of the radially protruding circumferential shoulder of the wet cylinder liner and a corresponding recess of the inner crankcase wall in which the circumferential shoulder of the wet cylinder liner is located.

9. The method according to claim 8, wherein the wet cylinder liner includes a radially protruding circumferential shoulder on the cylinder head side of the coolant channel.

10. The method according to claim 9, wherein at least one of the first upper sealing arrangement and the second upper sealing arrangement is located between the circumferential shoulder of the wet cylinder liner and the inner crankcase wall.

11. The method according to claim 8, wherein at least one venting channel is arranged in the inner crankcase wall between the first upper sealing arrangement and the second upper sealing arrangement.

12. A cylinder liner for a wet liner crankcase of a reciprocating machine, comprising:

a wet cylinder liner, the wet cylinder liner being configured to receive a reciprocating piston therein and to be inserted into the wet liner crankcase, wherein an outer wall of the wet cylinder liner is configured to cooperate with an inner wall of the wet liner crankcase to form a circumferential coolant channel therebetween, and receive therebetween a lower sealing arrangement on a crankshaft side of the circumferential coolant channel configured to prevent leakage of coolant fluid, a first upper sealing arrangement on a cylinder head side of the circumferential coolant channel configured to prevent leakage of coolant fluid; and a second upper sealing arrangement spaced axially apart from the first upper sealing arrangement, the second upper sealing arrangement being located radially between and in contact with the inner crankcase wall and the wet cylinder liner, and axially between the first upper sealing arrangement and a cylinder head end of the wet cylinder liner within a groove in at least one of the wet cylinder liner and the inner crankcase wall in an inner region of the wet cylinder liner in which gas is pressurized, the second upper sealing arrangement being configured to prevent pressurized gas being applied to the first upper sealing arrangement, the wet cylinder liner includes a radially protruding circumferential shoulder on the cylinder head side of the coolant channel, and the outer wall of the wet cylinder liner includes a chamfer at a crankshaft side of the radially protruding circumferential shoulder of the wet cylinder liner configured to receive the first upper sealing arrangement.

13. The cylinder liner according to claim 12, wherein the outer wall of the wet cylinder liner is configured to receive at least one of the first upper sealing arrangement and the second upper sealing arrangement between the circumferential shoulder of the wet cylinder liner and the inner crankcase wall.

14. The cylinder liner according to claim 12, wherein the second upper sealing arrangement is received on the cylinder head side of the outer wall of the wet cylinder liner.

15. The cylinder liner according to claim 12, wherein at least one of the first upper sealing arrangement, the second upper sealing arrangement and the lower sealing arrangement is received in a circumferential groove formed in the outer wall of the wet cylinder liner.

16. The cylinder liner according to claim 12, wherein the outer wall of the wet cylinder liner includes a chamfer at a crankshaft side of the radially protruding circumferential shoulder of the wet cylinder liner configured to receive the first upper sealing arrangement.

* * * * *